US007726503B2

(12) United States Patent
Dygert et al.

(10) Patent No.: US 7,726,503 B2
(45) Date of Patent: Jun. 1, 2010

(54) ERGONOMIC PLASTIC CONTAINER AND PACKAGE SYSTEM

(75) Inventors: Douglas M. Dygert, Olive Branch, MS (US); Daniel W. Gamber, Lakeland, TN (US); Eugene E. Kuhar, Lakeland, TN (US); Gary W. Price, Columbia, TN (US)

(73) Assignee: RING Container Technologies, Oakland, TN (US)

( * ) Notice: Subject to any disclaimer, the term of this patent is extended or adjusted under 35 U.S.C. 154(b) by 643 days.

(21) Appl. No.: 11/525,866

(22) Filed: Sep. 25, 2006

(65) Prior Publication Data

US 2008/0073317 A1 Mar. 27, 2008

(51) Int. Cl.
*B65D 5/56* (2006.01)
*B65D 23/10* (2006.01)

(52) U.S. Cl. ..... 220/23.91; 220/23.87; 220/771; 222/608; 222/465.1; 229/117.35; 215/398

(58) Field of Classification Search ..... 215/395–398; 220/62.2, 83.6, 771, 23.87, 23.91; 222/466, 222/465.1, 608; 229/117, 13, 117.24, 109, 229/117.35, 918, 117.13; 206/509
See application file for complete search history.

(56) References Cited

U.S. PATENT DOCUMENTS

| | | | | |
|---|---|---|---|---|
| 236,359 | A * | 1/1881 | Reynolds | 222/466 |
| 1,331,409 | A | 2/1920 | Barnett | |
| 1,627,651 | A * | 5/1927 | Kautzsch | 36/36 R |
| 3,119,544 | A | 1/1964 | Cope et al. | |
| 3,160,326 | A | 12/1964 | Sturdevant et al. | |
| 3,349,986 | A | 10/1967 | Chapman et al. | |
| 3,400,846 | A | 9/1968 | Kelly | |
| 3,499,582 | A | 3/1970 | Berney | |
| 3,927,797 | A | 12/1975 | Flider | |
| 4,133,428 | A | 1/1979 | Glöyer | |
| D277,552 | S | 2/1985 | Küng | |
| 4,804,119 | A | 2/1989 | Goodall | |
| 4,805,793 | A | 2/1989 | Brandt et al. | |
| D305,982 | S | 2/1990 | Gillispie et al. | |
| 4,923,098 | A * | 5/1990 | Schoonover et al. | 222/465.1 |
| 5,265,743 | A | 11/1993 | Frohn | |
| 5,340,000 | A * | 8/1994 | Ring | 222/468 |
| 5,462,169 | A | 10/1995 | Dygert et al. | |
| 5,497,899 | A | 3/1996 | Wuerfel | |
| 5,660,301 | A | 8/1997 | Kaplowitz | |
| 5,765,711 | A | 6/1998 | Johnson et al. | |

(Continued)

FOREIGN PATENT DOCUMENTS

EP 1060995 A2 * 12/2000

*Primary Examiner*—Sue A Weaver
(74) *Attorney, Agent, or Firm*—Sughrue Mion, PLLC

(57) ABSTRACT

A packing that includes a bottle and/or a bottle and box combination wherein the container may have a first handle portion, a second handle portion, and a bottom grip portion. The first handle portion can extend in a front to back direction and the second handle portion can extend in a transverse direction to the first handle portion. The bottom grip may include a protrusion and recess on the bottom of the container. The box can be configured to have openings to provide access to the first and second handle portions such that the container need not be removed from the box to utilize the contents contained therein. The box may also include a bottom opening and a push-up portion to provide access to the bottom grip portion.

30 Claims, 9 Drawing Sheets

U.S. PATENT DOCUMENTS 5,779,051 A * 7/1998 Boutin ..... 206/504
D397,036 S 8/1998 Katakouzinos
5,908,136 A * 6/1999 Mrak ..... 220/756
6,045,036 A 4/2000 Ring
6,237,792 B1 5/2001 Skolnicki et al.
6,588,612 B1 7/2003 Dorn et al.
D488,067 S 4/2004 Dorn et al.
7,000,794 B2 * 2/2006 Soehnlen et al. ..... 215/398
2003/0132184 A1 7/2003 Dorn et al.
2003/0160092 A1 8/2003 Philips et al.
2004/0188504 A1 9/2004 Pierce
2006/0180643 A1 * 8/2006 Stephenson ..... 229/117.3
2006/0202004 A1 * 9/2006 Holt ..... 229/117.3

* cited by examiner

ERGONOMIC PLASTIC CONTAINER AND PACKAGE SYSTEM

BACKGROUND OF THE INVENTION

1. Field of the Invention

The present invention relates to an ergonomically designed container and package system.

2. Description of the Related Art

Multiple use container and composite packaging systems have been utilized in order to facilitate the storage and transport of a variety of materials. Often the container is used as the primary means for containing the material such that the material is sealed within the container. These materials may include wet or dry goods and may come in a variety of dimensions. In some cases, the packaging system may further comprise an external box for housing the container. The box may be used to provide additional strength and/or protection and often provides a packaging that is more suitable for stacking and transport. The external box also provides a surface that is suitable for advertising and describing the product contained therein.

Both the container and the packaging system may be used for the purpose of storing a material from the point of manufacture until it is delivered to its subsequent end use. Furthermore, the container in a package combination results in a configuration that is easily stackable for storage and transport in multiple unit stacking configurations.

However, the conventional containers available suffer from the drawback that they are not susceptible to being both stackable as well easily handled by a user for both carrying and pouring. Additionally, when the size and weight of the container is increased, this drawback may become even more problematic. Furthermore, most composite packaging systems require that the container be withdrawn from the box in order to access the contents contained therein. This is especially problematic when the spout must be accessed in order to pour contents from the container. Thus, the container, during use, loses the benefits associated with the box portion of the packaging system, e.g., the ability to be conveniently stacked.

Therefore, there is a need for an improved container that provides for better ergonomic handling during both pouring and carrying. Additionally, there is a need for a packaging including a container in a box, wherein the container may remain in the box during use.

SUMMARY OF THE INVENTION

Accordingly, an aspect of the present invention is to provide a container having top, a bottom, sides extending from the top to the bottom having a front side and a back side, a spout for inserting and removing contents from the container, a first handle portion on the top and extending generally in a direction front to back, a second handle portion on the top and extending in a direction transverse to the first handle portion.

Furthermore, the container may have a manual grip on the bottom of the container for supporting the container from the bottom.

According another aspect of the present invention, the spout may be disposed on or near the front top side of the container and the second handle portion may be disposed toward the backside. The first handle portion and the second handle portion may be connected to form a "T"-shape.

According to another aspect of the present invention the second handle portion in the direction transverse to the first handle portion may be shaped so as to be grasped by a thumb. Preferably, the second handle portion may range from two to four inches and, most preferably, three inches.

According to another aspect of the present invention, the manual grip on the bottom is formed by an indentation on the bottom of the container. Alternatively, this grip may be formed by a protrusion or both a recess and a protrusion.

According to another aspect of the present invention, a packaging is provided, having a container in a box, the container including: a top, a bottom, sides extending from the top to the bottom and having a front side and a back side, a spout for inserting and removing contents from the container, a first handle portion on the top and extending generally in a direction front to back, a second handle portion on the top and extending in a direction transverse to the first handle portion, and a manual grip on the bottom of the container. The the box may have has a top cover, a bottom cover and side portions extending from the top cover to the bottom cover that include at a front side and a back side, one or more openings on the top cover that expose the spout for pouring the contents of the container and for accessing the second handle portion so that the second handle portion can be manually grasped while remaining inside in the box, and an opening in the bottom cover that expose the bottom grip.

According to another aspect of the invention, there is a method of using the foregoing container and packing.

BRIEF DESCRIPTION OF THE DRAWINGS

The above and other features and aspects of the present invention will become more apparent by describing non-limiting exemplary embodiments thereof with reference to the attached drawings in which.

DETAILED DESCRIPTION OF THE INVENTION

The container and packing system according to non-limiting exemplary embodiments of the present invention will now be described more fully with reference to the accompanying drawings.

Figure 1:
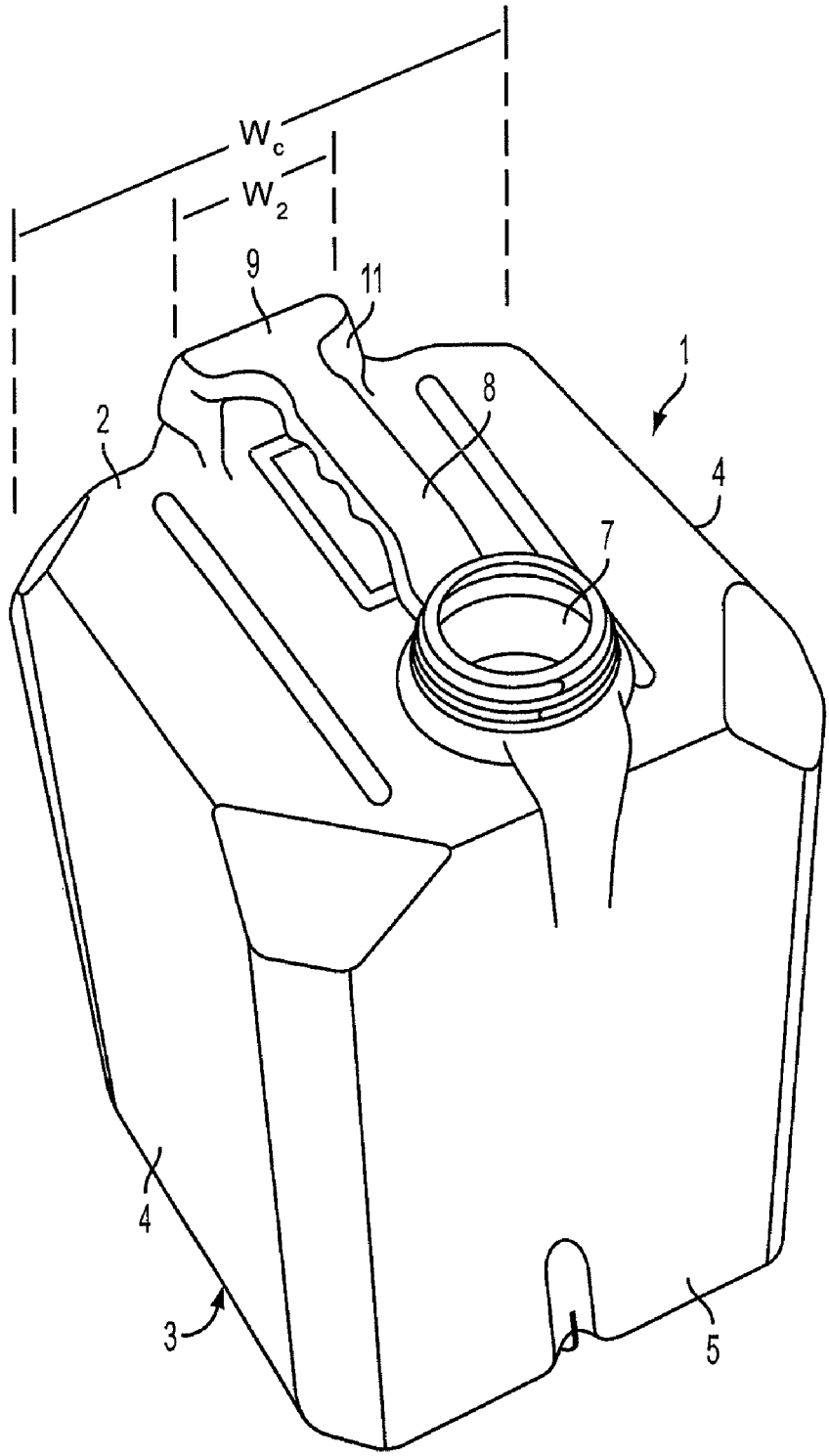
FIG. 1 is a perspective view of a container according to a non-limiting exemplary embodiment of the present invention.
Figure 2:
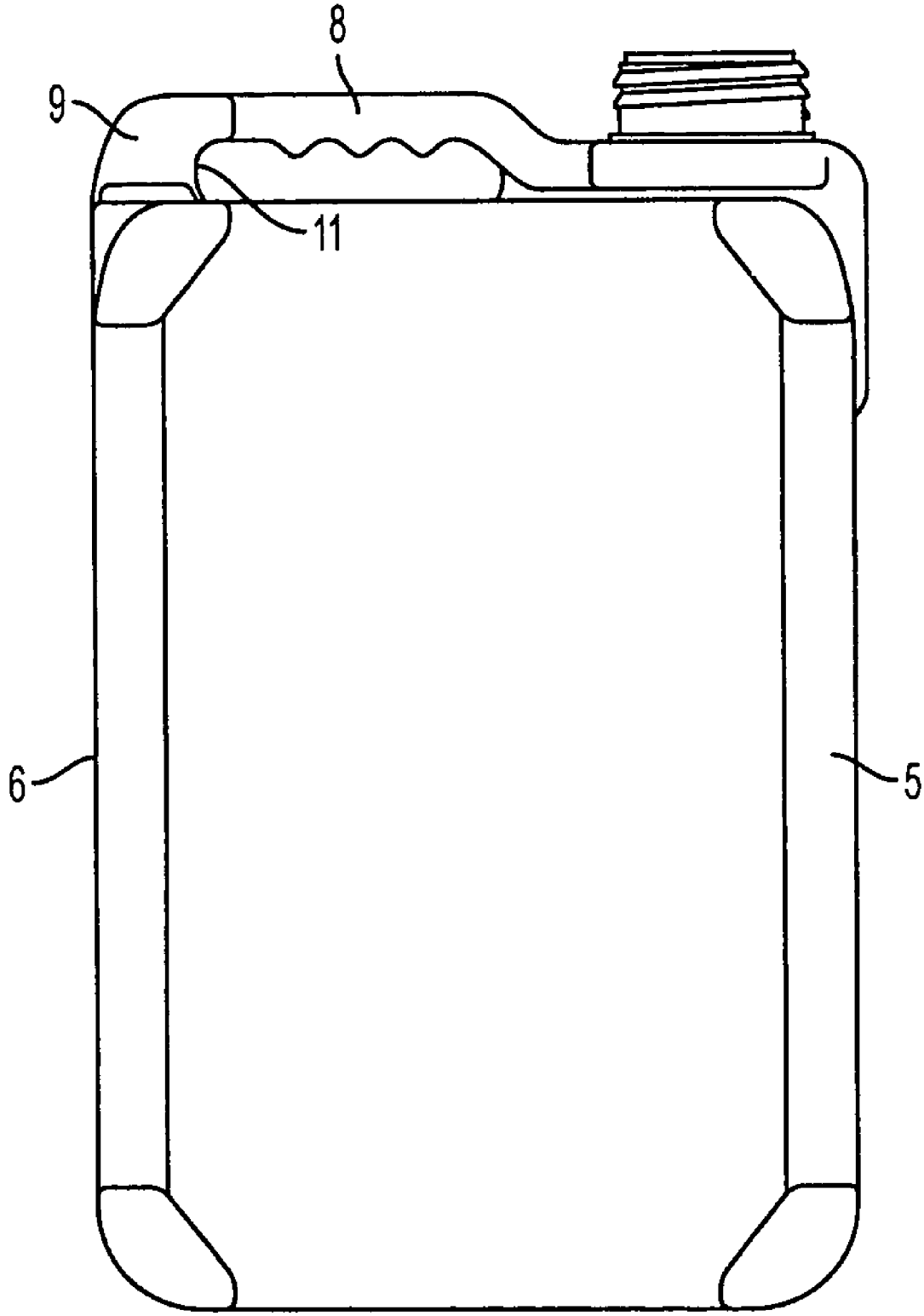
FIG. 2 is a side view of the container of FIG. 1.

Referring to the exemplary embodiment shown in FIG. 1, a container 1 is shown having a top 2 and a bottom 3 connected by sides 4 that extend from the top 2 to the bottom 3. The container 1 includes a spout 7 that permits filling or dumping of the contents. Also located on the top 2 is a first handle portion 8 that extends from the spout 7 located near the front side 5 of the container 1 and a second handle portion 9 extending transverse to the first handle portion. In this embodiment, the second handle portion 9 is also shown connected to the first handle portion 8 on an end opposite the spout 7. This embodiment also includes, as shown in FIG. 3, a grip 10 on the bottom 3 of the container 1.

The container may be made of plastic, which can be blow molded into various configurations, however, any material suitable for containing a particular kind of content may be used.

To facilitate handling in a variety of positions, the first handle portion 8, the second handle portion 9 and the bottom grip 10, are included. For use in a carrying position, the first handle portion 8 is formed in an elongated fashion, which extends from the front side 5 to the back side 6 and provides for a space between the first handle portion 8 and the top 2 of the container for inserting a hand. Thus, a user may slip his fingers through the first handle portion 8 to lift the container 1. Additionally, when used in a pouring position, such as when tilted forward, the second handle portion 9 is provided and extends in a direction transverse to the first handle portion. This facilitates handling when the container is tilted off vertical, such as when emptying the contents of the container 1. This second handle portion 9 may be utilized in tandem with the bottom grip 10 so that the container 1 may be gripped using two hands when tipped to pour the contents from the container 1. These handle and grip configurations provide for stable and secure handling, especially when the container is heavy.

Figure 4:
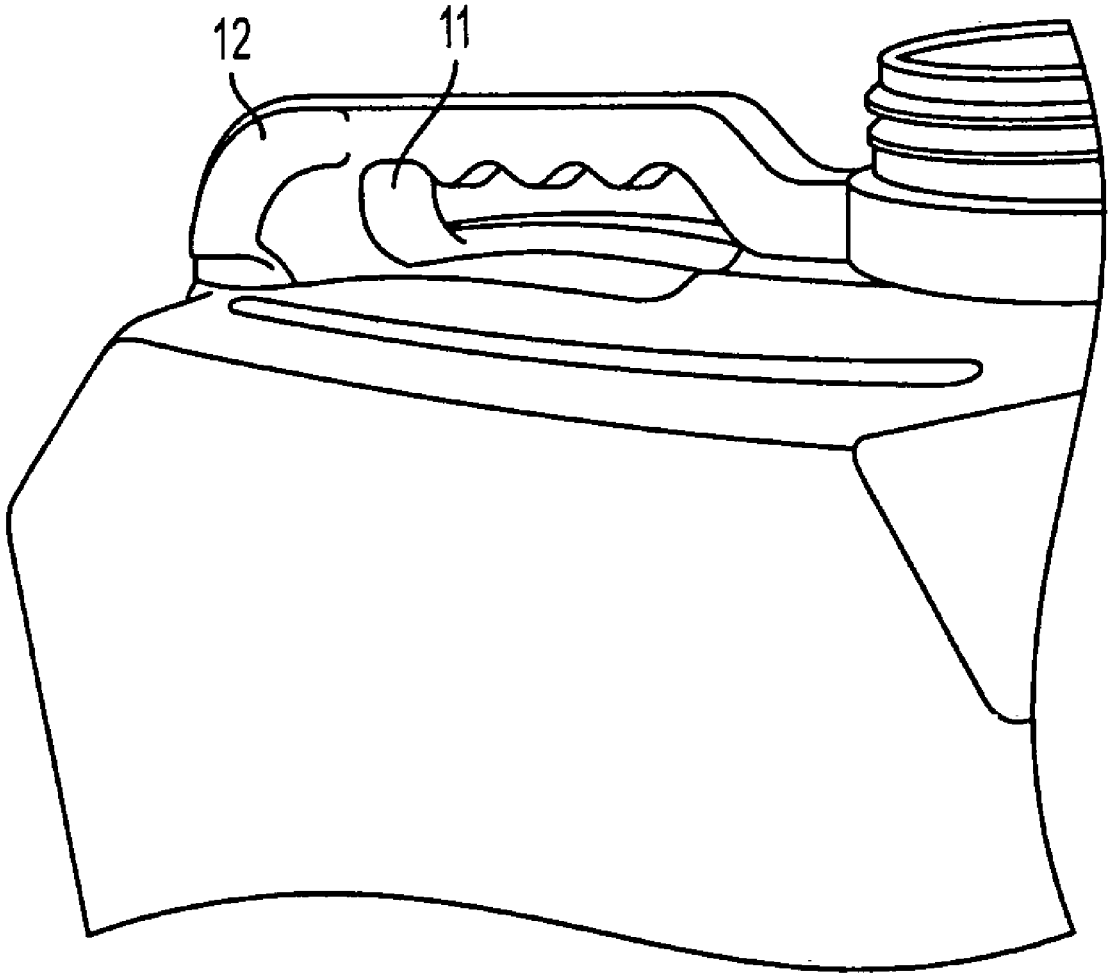
FIG. 4 is a perspective view illustrating features of the second handle portion according to a non-limiting exemplary embodiment of the present invention.

In the exemplary embodiment shown in FIG. 4, the second handle portion 9 provides a forward facing surface 11 that extends from the top of the container 1 and provides a gripping surface to facilitate tipping the container 1 forward to pour out its contents. A portion of the first handle portion 8, where it connects with the second handle portion 9, may be necked down to form a narrowed neck portion 12. This tapered or necked down portion improves finger reception when gripping the second handle portion 9 and its forward facing surface 11. The forward facing surface 11 may also be formed with a curved profile as shown in FIG. 4 to further improve gripping.

The second handle portion 9 may have a width that is convenient for gripping around its side by the thumb and over the top by the remaining fingers. For example, the width of the second handle portion $W_2$ preferably ranges from one-fourth to three-quarters of the width of the container $W_c$. More preferably, the width of the second handle portion $W_2$ ranges from one-third to one-half the width of the container $W_c$. In inches, the width of the second handle portion $W_2$ may range from 2-4 inches and, preferably, about three inches.

Figure 3A:
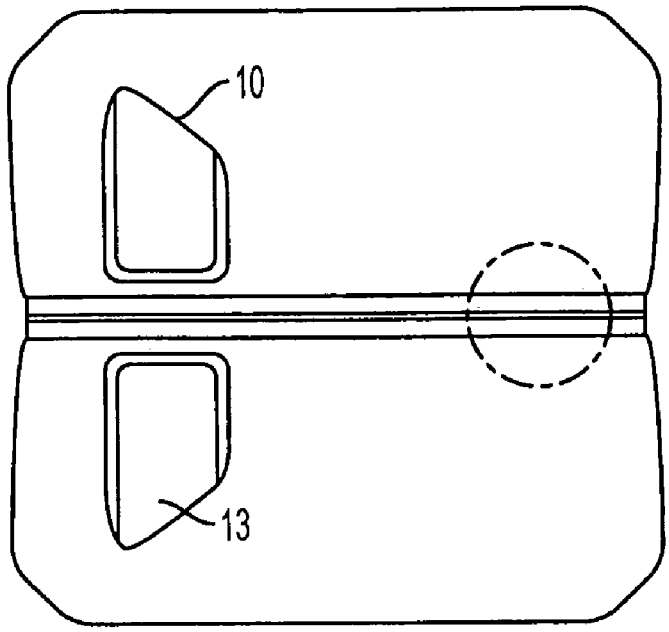
FIG. 3A is a bottom view of the container of FIG. 1.
Figure 3B:
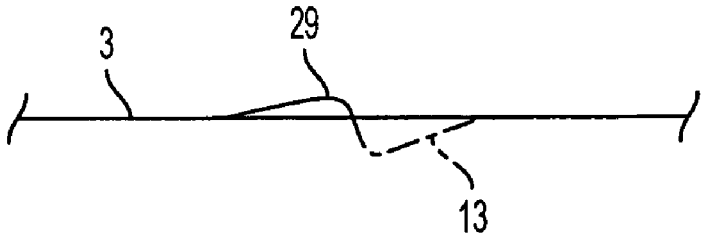
FIG. 3B is a profile view of the container bottom of FIG. 3A.
Figure 9:
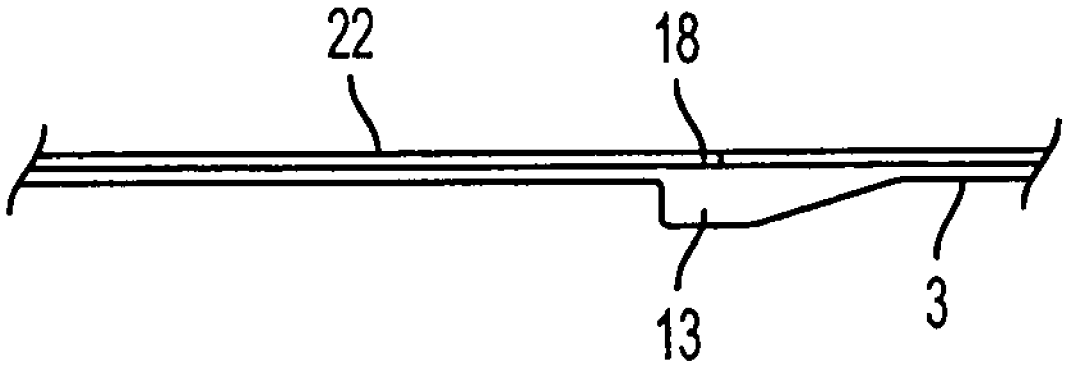
FIGS. 9 and 10 are side views of a portion of the bottom of the packaging illustrating the pushup portion and recess portions of the bottom of the packaging.

The bottom grip 10, similar to the second handle portion 11, may be formed for gripping the container 11 when it is tilted for pouring. A recess 13 in the bottom, as shown in FIGS. 3A, 3B and 9, may be used to form this bottom grip. Alternatively, as best shown in FIG. 3B, the bottom grip 10 may formed by a protrusion on the surface or by combining both a recess and a protrusion.

Containers having these features may be advantageous when handling specific volumes of heavy fluids or materials.

Figure 5:
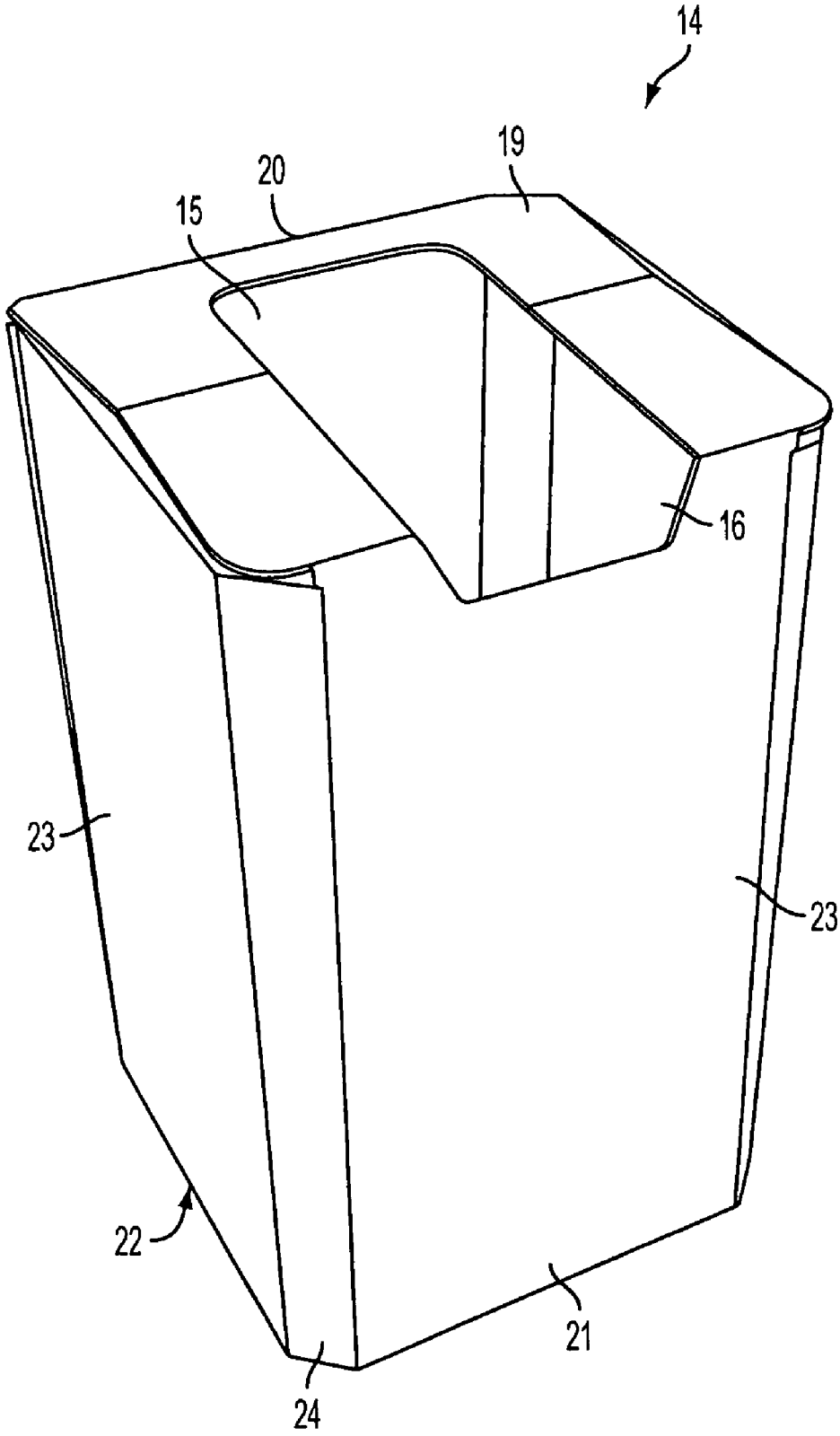
FIG. 5 is a perspective view of a box according to a non-limiting exemplary embodiment of the present invention.
Figure 6:
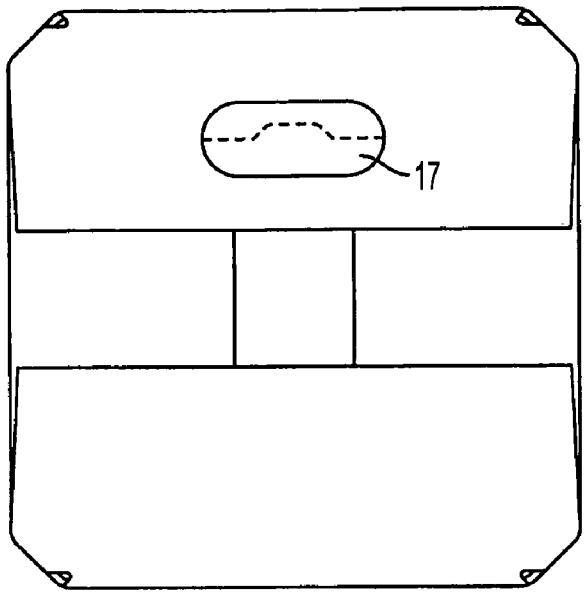
FIG. 6 is a bottom view of the bottom of a box illustrating a bottom opening according to a non-limiting embodiment of the present invention.
Figure 7:
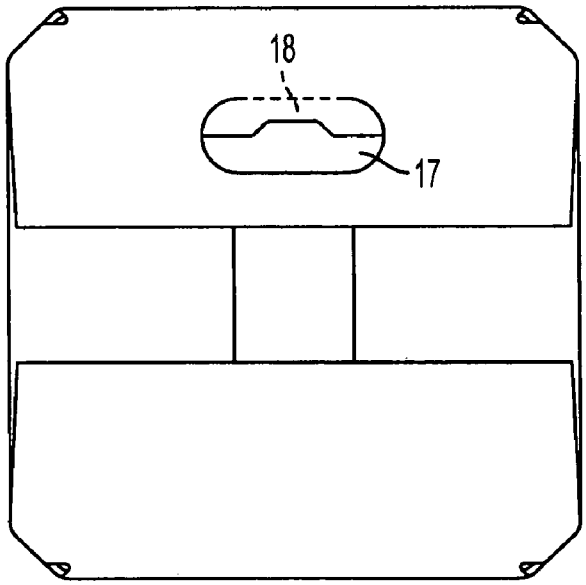
FIG. 7 is a view of the bottom of a box illustrating a bottom opening and a push-up portion according to another non-limiting exemplary embodiment of the present invention.
Figure 8:
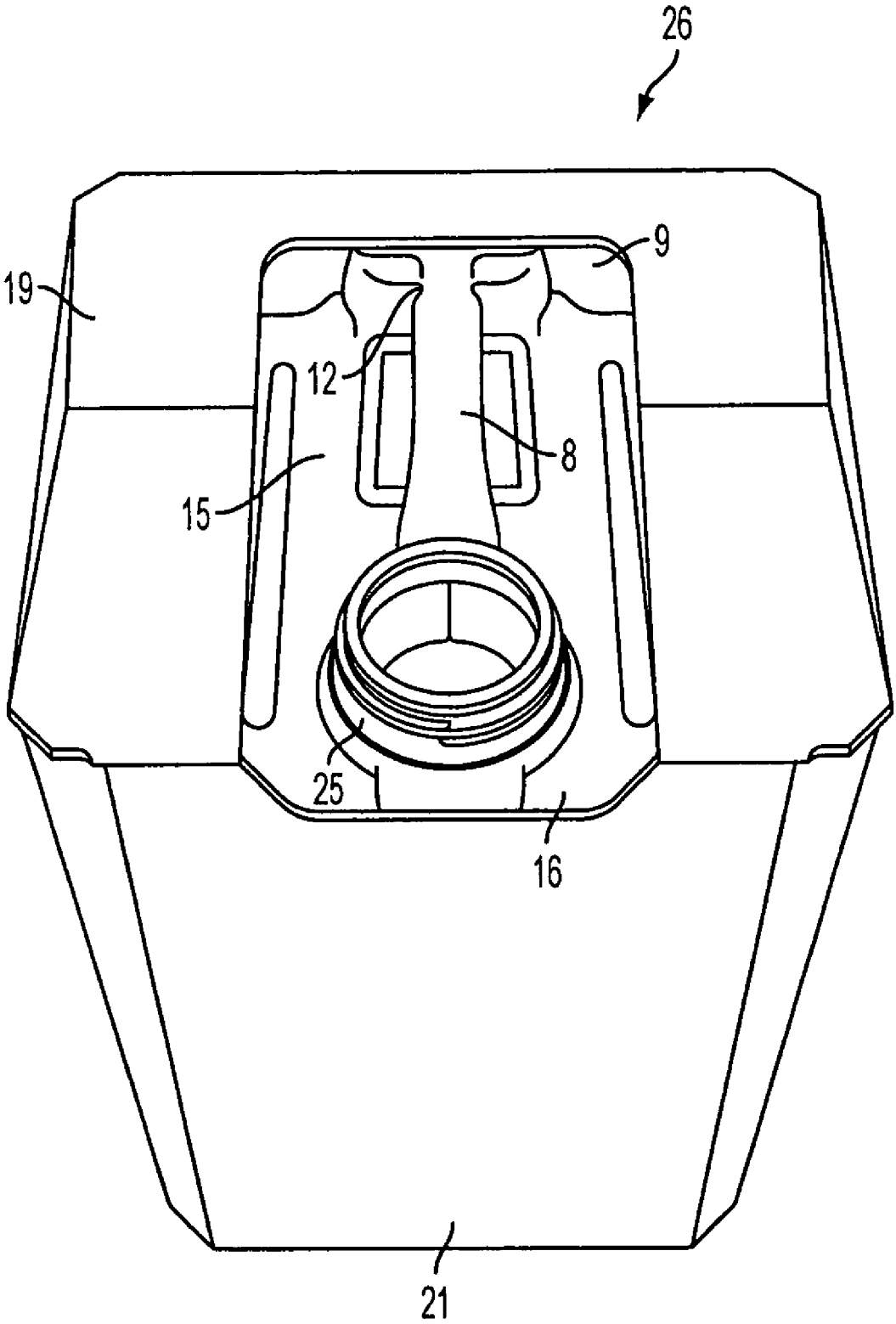
FIG. 8 is a perspective view of a packaging comprising a container and a box according to a non-limiting exemplary embodiment of the present invention.

In another preferred embodiment of the invention, the container 1 is enclosed within a box 14 to create a packaging system 26 as shown in FIG. 8. The box 14, as illustrated in FIGS. 5, 6 and 7, for example, includes a top cover 19, a bottom cover 22 and a plurality of sides 23. In the embodiment of FIG. 5, the sides are shown joined to each other by vertical chamfered corners 24. The container is further fitted with openings to permit access to the spout 7 and the handling portions. In particular, a top opening 15 permits access to the spout 7, the first handle portion 8 and the second handle portion 9, while the bottom grip 10 is accessible via a bottom opening 17 as illustrated, for example, in FIG. 6. However, access to these portions may be provided by more than one opening if desired.

Additionally, to improve the ergonomics of the packaging system, the box 14 may include a notch section 16 in the front 21 of the box 14 for exposing a portion of the neck 25 of the spout 7. This notch section 16 improves access to the spout 7 and also prevents the contents, when being poured from the container 1, from entering the inside of the box 14. The top opening 15 in this embodiment may also extend to the end of the first handle portion 8 to expose the narrowed neck portion 12. Thus, the second handle portion 9, while positioned under the top cover 19, is accessible for handling when pouring the contents from the container 11.

Figure 10:
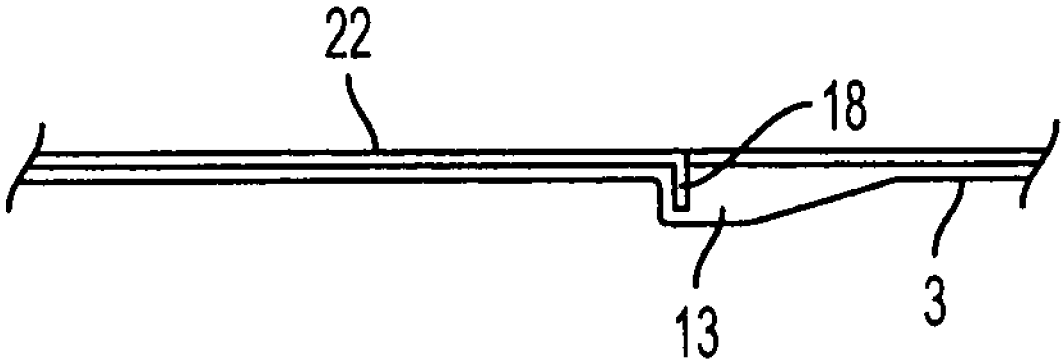

Referring to FIGS. 9 and 10, while the bottom cover can be fitted with a bottom opening 17 to provide access to the bottom grip 10, a push-up portion 18 may also be included to provide an ergonomically improved grip. As shown in FIG. 10, the bottom opening 17 may comprise both an opening and a perforated portion, which defines the push-up portion 18. Alternatively, the push-up portion may merely constitute a flap that covers a portion of bottom opening 17. In operation, when the push-up portion 18 is pushed into recess 13 a slightly larger surface is formed for grasping and the box edge become smooth due to the fold 27.

This packaging system provides unique features that permit use of the above-described container 1 without removal of the container from the box 14. The box 14 is configured to permit access to the spout 7 for removing a lid or the like, and permits access to all the potential grasping points so that the packaging system 26 may be carried or used to pour contents from the container 1. Furthermore, the packaging system 26 provides a strong, stackable package for continual use until all the contents of the container 1 are consumed.

Another feature of this embodiment provides that both the container 11 and the box are fitted with chamfered corners 24, 28 to improve the strength and stackability of the packaging system 26. With regard to strength improvements, the chamfered corners 24, 28 make the package less susceptible to structural damage from blows directed at the corners of the box 14. Furthermore, the chamfered corners 24 facilitate the adjacent stacking of multiple packaging systems on either a pallet or a warehouse space. Moreover, the improved structural characteristics permit more weight to be stacked vertically above each packaging system 26. The chamfered corners 24, 28 also provide a unique surface for displaying advertisements and the like.

Figure 11:
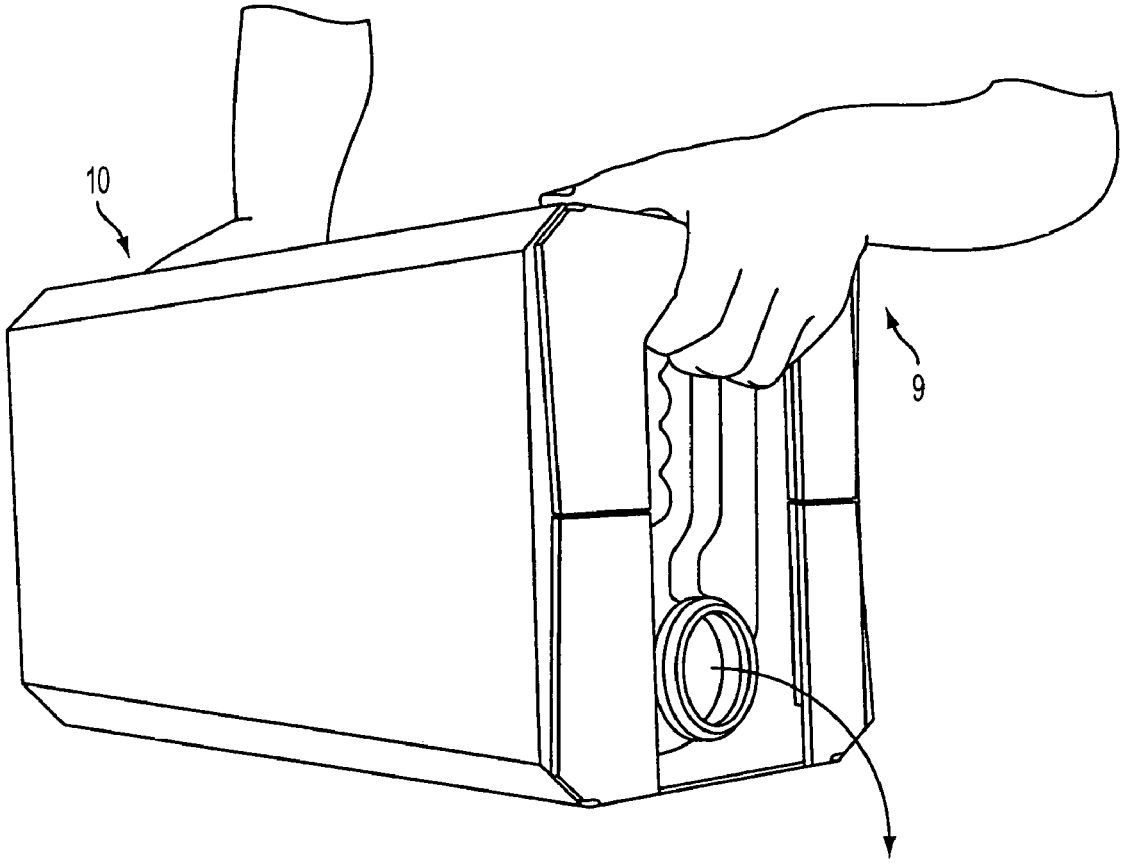
FIG. 11 illustrates a person pouring contents from the packaging of the present invention.

Illustrated in FIG. 11 is a method for using the packaging system 26. In order to empty contents from the container 1, a user may grab the second handle portion 9 with one hand. Then the user may grab the bottom grip 10 with the other hand. Now in order to tilt the container 1 to empty the contents, the user pushes upwards on the bottom grip 10, which causes a titling of the container 1 and a subsequent pouring of the contents therefrom.

While this invention has been particularly shown and described with reference to exemplary embodiments thereof, the above description should be considered in as illustrations of the exemplary embodiments only and are not for purposes of limitation. Therefore, the scope of the invention is defined not by the detailed description of the invention but by the appended claims, and all differences within the scope will be construed as being included in the present invention.

What is claimed is:

1. A container comprising:

a top;

a bottom;

sides extending from the top to the bottom and comprising a front side and a back side at a front and back of the container, respectively;

a spout;

a first handle portion on the top and extending generally in a direction front to back; and a second handle portion on the top and extending in a direction transverse to the first handle portion;

wherein the second handle portion is configured to be grasped by one hand.

2. The container according to claim 1, further comprising a bottom grip on the bottom of the container.

3. The container according to claim 1, wherein the spout is disposed on the top of the container.

4. The container according to claim 1, wherein the spout is disposed at or near the front side.

5. The container according to claim 1, wherein the second handle portion is disposed at or near the back side.

6. The container according to claim 4, wherein the first handle portion and the second handle portion are connected to form a T-shape.

7. The container according to claim 6, wherein a width of the second handle portion in the direction transverse to the first handle portion is sized so as to be grasped with a thumb of a person's hand from a side of the second handle portion while simultaneously being grasped by the remaining fingers of the person's hand over a top of the second handle portion.

8. The container according to claim 6, wherein a width of the second handle portion in the direction transverse to the first handle portion ranges from about ¼ to ¾ of a width of the back side.

9. The container according to claim 6, wherein a width of the second handle portion in the direction transverse to the first handle portion ranges from about ⅓ to ½ of a width of the back side.

10. The container according to claim 6, wherein a width of the second handle portion in the direction transverse to the first handle portion ranges from about 2-4 inches.

11. The container according to claim 6, wherein a width of the second handle portion in the direction transverse to the first handle portion is about 3 inches.

12. The container according to claim 6, wherein the second handle portion has a curved profile when viewed from a side of the container in the direction transverse to the first handle portion, the curved profile extending towards the front of the container so as to permit a persons fingers to wrap around and securely grip the second handle portion.

13. The container according to claim 6, wherein the first handle portion has a narrowed neck portion adjacent to the second handle portion for receiving fingers when the second handle portion is gripped.

14. The container according to claim 2, wherein the bottom grip comprises an indentation on the bottom of the container, the indentation extending in a direction parallel to second handle portion.

15. The container according to claim 2, wherein the bottom grip comprises a protrusion extending from a surface of the bottom of the container, the protrusion extending in a direction parallel to second handle portion.

16. The container according to claim 1, wherein the second handle portion has a curved profile when viewed from a side of the container in the direction transverse to the first handle portion, the curved profile extending towards the front of the container so as to permit a persons fingers to wrap around and securely grip the second handle portion.

17. The container according to claim 16, wherein the first handle portion and the second handle portion are connected to form a T-shape; and wherein the first handle portion has a narrowed neck portion adjacent to the second handle portion for receiving fingers when the second handle portion is gripped.

18. The container according to claim 17, further comprising a bottom grip on the bottom of the container;

wherein the bottom grip comprises an indentation on the bottom of the container, the indentation extending in a direction parallel to second handle portion.

19. The container according to claim 18, wherein the spout is disposed at or near the front side; and wherein the second handle portion is disposed at or near the back side.

20. A method of using a container, the method comprising:

providing a container according to claim 1;

grasping the second handle portion with one hand;

grasping the bottom grip with another hand; and tilting the container by pushing upwards on the bottom grip to empty the contents from the container.

21. A packaging comprising:

a container in a box;

the container comprising:

a top;

a bottom;

sides extending from the top to the bottom and comprising a front side and a back side at a front and back of the container respectively;

a spout;

a first handle portion on the top and extending generally in a direction front to back;

a second handle portion on the top and extending in a direction transverse to the first handle portion, wherein the second handle portion is configured to be grasped by one hand; and a grip for manually gripping on the bottom of the container; and the box comprising:

a top cover, a bottom cover and side portions, including a front side and a back side;

one or more openings on the top cover that exposes the spout for pouring the contents of the container and for accessing the second handle portion so that the second handle portion is accessible for manually gripping while inside the box; and an opening in the bottom cover that exposes the bottom grip.

22. The packaging according to claim 21, wherein there is a separate opening on the top cover for each of the spout and the second handle portion.

23. The packaging according to claim 21, wherein the spout includes a neck extending from the container and the top cover opening includes a notch in the front side of the box to expose at least a portion of the neck.

24. The packaging according to claim 21, further comprising a push up portion connected to the bottom cover of the box and disposed within the opening in the bottom cover that provides a smooth edge when gripping the grip.

25. The container of claim 21, wherein container comprises eight sides extending from the top to the bottom and wherein the box comprises eight side portions extending from the top cover to the bottom cover.

26. The container of claim 21, wherein the sides extending from the top to the bottom comprise:

the front side, the back side, a right and left side at the right and left of the container respectively; and wherein at least two sides selected from: the front side, the back side, the right side, and the left side are connected by a chamfer portion.

27. The packaging of claim 21, wherein the first handle portion and the second handle portion are connected to form a T-shape.

28. A packaging comprising:

a container in a box;

the container comprising:

a top;

a bottom;

sides extending from the top to the bottom and comprising a front side and a back side at a front and back of the container, respectively;

a spout;

a first handle portion on the top and extending generally in a direction front to back;

a second handle portion on the top and extending in a direction transverse to the first handle portion, wherein the second handle portion is configured to be grasped by one hand; and a grip for manually gripping on the bottom of the container; and the box comprising:

a top cover, a bottom cover and side portions extending from the top cover to the bottom cover;

one or more perforated portions on the top cover that are removable to create one or more openings on the top cover that expose the spout for pouring the contents of the container and for accessing the second handle portion of handle so that the second portion of the handle can be manually gripped while confined in the box; and a perforated portion in the bottom cover that is removable to expose an opening in the bottom cover that expose the bottom grip.

29. A packaging comprising:

a container in a box;

the container comprising:

a top;

a bottom;

sides extending from the top to the bottom and comprising a front side and a back side at a front and back of the container respectively, and flat planar side portions disposed between each side of the front side and the back side so as to intersect at an angle greater than 900 with front side and back side, respectively;

and the box comprising:

a top cover, a bottom cover and side portions, including a box front side and a box back side at a front and back of the box respectively, and flat box planar side portions disposed between each side of the box front side and the box back side so as to intersect at an angle greater than 90° with the box front side and the box back side, respectively.

30. The packaging of claim 29, wherein the flat planar side portions and the flat box planar side portions are chamfered corners to permit the container surface to contact the box surface.

* * * * *